US012584307B1

(12) United States Patent
Osborne et al.

(10) Patent No.: US 12,584,307 B1
(45) Date of Patent: Mar. 24, 2026

(54) CORNER SYSTEMS FOR SANDWICH PANELS

(71) Applicant: LH Darkrooms, LLC, Pearland, TX (US)

(72) Inventors: David Osborne, Houston, TX (US); Robert Harris, Seabrook, TX (US); Ryan Hagan, Seabrook, TX (US)

(73) Assignee: LH Darkrooms, LLC, Pearland, TX (US)

( * ) Notice: Subject to any disclaimer, the term of this patent is extended or adjusted under 35 U.S.C. 154(b) by 0 days.

(21) Appl. No.: 19/087,284

(22) Filed: Mar. 21, 2025

Related U.S. Application Data

(60) Provisional application No. 63/749,477, filed on Jan. 24, 2025, provisional application No. 63/697,931, filed on Sep. 23, 2024.

(51) Int. Cl.
*E04B 1/38* (2006.01)
*E04B 1/61* (2006.01)
*E04F 13/076* (2006.01)

(52) U.S. Cl.
CPC ..... *E04B 1/388* (2023.08); *E04B 1/61* (2013.01); *E04F 13/076* (2013.01); *E04B 2001/6195* (2013.01)

(58) Field of Classification Search
CPC .... E04B 1/388; E04B 1/61; E04B 2001/6195; E04F 13/076
USPC ..... 52/79.9
See application file for complete search history.

(56) References Cited

U.S. PATENT DOCUMENTS 2,373,789 A * 4/1945 Smith ..... E04B 2/702 52/772
2,793,245 A * 5/1957 Dunn ..... H05K 9/0001 52/273
2,860,176 A * 11/1958 Lindgren ..... H05K 9/0001 217/17
3,322,879 A * 5/1967 Lindgren ..... H05K 9/0001 52/794.1
3,440,790 A * 4/1969 Nerem ..... E04C 2/32 52/273
3,706,168 A * 12/1972 Pilish ..... E04B 1/04 52/234
4,038,804 A * 8/1977 Haage ..... E04D 5/147 52/544
4,158,338 A * 6/1979 Dippold ..... E05G 1/024 89/36.17
4,196,549 A * 4/1980 Levinton ..... E04B 1/34815 52/79.9
4,638,606 A * 1/1987 Wendt ..... E04B 2/7457 52/36.6
4,689,930 A * 9/1987 Menchetti ..... E04B 2/7409 52/468
4,706,426 A * 11/1987 Rumsey ..... E04F 19/028 52/255
4,740,654 A * 4/1988 Lindgren ..... H05K 9/0001 403/364
4,806,703 A * 2/1989 Sims ..... H05K 9/0001 174/373

(Continued)

*Primary Examiner* — James J Buckle, Jr.
(74) *Attorney, Agent, or Firm* — McAughan Deaver PLLC

(57) ABSTRACT

A corner assembly for a sandwich panel system comprising an interior component with two or more flange portions arranged in an L- or T-shape and an exterior component, for securing the panels in a corner configuration.

12 Claims, 11 Drawing Sheets

(56) References Cited

U.S. PATENT DOCUMENTS

| | | | | | |
|---|---|---|---|---|---|
| 5,138,810 | A * | 8/1992 | Kartler | E04F 13/06 | 52/255 |
| 5,417,026 | A * | 5/1995 | Brumfield | E04B 7/20 | 52/783.11 |
| 5,490,361 | A * | 2/1996 | Gingras | E04H 5/10 | 52/270 |
| 5,509,242 | A * | 4/1996 | Rechsteiner | E04C 2/296 | 52/287.1 |
| 5,806,253 | A * | 9/1998 | Nelson | E04F 11/166 | 52/718.04 |
| 5,934,741 | A * | 8/1999 | Beukers | B60P 3/20 | 296/181.6 |
| 6,224,125 | B1 * | 5/2001 | McCormack | B62D 33/044 | 296/210 |
| 7,390,052 | B2 * | 6/2008 | Bertoch | B62D 21/20 | 296/156 |
| 8,061,105 | B2 * | 11/2011 | Haga | E04B 2/7457 | 52/631 |
| 10,801,212 | B2 * | 10/2020 | Woo | E04F 13/06 | |
| 11,614,272 | B2 * | 3/2023 | Gingras | E04B 1/388 | 29/897.32 |
| 12,129,667 | B2 * | 10/2024 | Mineo | E04F 13/06 | |
| 2002/0062616 | A1 * | 5/2002 | Ocampo | E04B 1/215 | 52/261 |
| 2008/0271402 | A1 * | 11/2008 | Gingras | E04B 1/34321 | 29/897.32 |
| 2021/0333042 | A1 * | 10/2021 | Gingras | E04B 1/388 | |
| 2022/0175156 | A1 * | 6/2022 | Eget | A47F 3/0469 | |
| 2024/0093485 | A1 * | 3/2024 | Gingras | E04B 1/6183 | |

* cited by examiner

CORNER SYSTEMS FOR SANDWICH PANELS

CROSS REFERENCE TO RELATED APPLICATIONS

This non-provisional application claims benefit of and priority to U.S. Provisional Application Ser. No. 63/697,931 filed on Sep. 23, 2024, and claims benefit of and priority to U.S. Provisional Application Ser. No. 63/749,477 filed on Jan. 24, 2025.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The present inventions relate to joinery for composite sandwich panels.

Description of the Related Art

A "sandwich panel" is generally, and without limitation, any structure made of three layers: a low-density core, and a thin skin-layer bonded to each side of the core. Sandwich panels provide a combination of high structural rigidity and low weight. The core may be a honeycomb, foam, or solid filling of a variety of materials or combination of materials, including polyethylene, polyurethane, mineral wool, PIR foams, PUR foams, polymethacrylimide, expanded polystyrene, extruded polystyrene, phenolic foam, and the like. The skin is usually aluminum or its alloys, a carbon fiber composite, and/or a fiber reinforced composite.

In building systems, sandwich panels may be joined together, such as at a corner, using exterior and interior joinery components. Aluminum extrusions and structural glues have been used to join sandwich panels.

US Published Application No. 2024/0183144 is entitled "Building Panels" and disclose "a method of constructing a building, comprising installing: a wall structure of the building, the wall structure comprising a panel having opposed skins and a core within which extends at least one cavity; and a ceiling structure of the building, such that the ceiling structure is adjacent the wall structure, and the wall structure bounds a space at a side of the space and the ceiling structure bounds the space at a top of the space, and such that: the space is sheltered and/or isolated from the elements; and/or lock-up is attained in respect of said space, the method further comprising: thereafter installing at least one service line through at least one said cavity of said panel and/or installing at least one service line which comprises at least one said cavity of that panel; and thereafter installing a roof structure of the building over the ceiling structure, wherein a connector is secured between the wall structure and the ceiling structure to form therebetween a connection which is such that the connector engages both the ceiling structure and at least one of the skins so as to direct, to the skin(s) engaged thereby, loading exerted by the ceiling structure, and wherein said at least one said cavity is accessed through said connector and/or through said ceiling structure, to install the service lines(s)."

It is to be understood that the discussion above is provided for illustrative purposes only and is not intended to and does not limit the scope or subject matter of the appended or ultimately issued claims or those of any related patent application or patent. Thus, none of the appended claims, ultimately issued claims or claims of any related application or patent are to be limited by the above discussion or construed to address, include, or exclude each or any of the above-cited features or disadvantages merely because such were mentioned herein.

BRIEF SUMMARY OF THE INVENTION

A brief summary of the inventions indicating their nature and substance may be understood from the subject matter presented in the claims filed with this application, which are incorporated into this brief summary by reference for all purposes, and by the inventions presented in any claims that may be issued from this application, which claims also are incorporated into this brief summary by reference for all purposes.

BRIEF DESCRIPTION OF THE SEVERAL VIEWS OF THE DRAWINGS

The following figures form part of the disclosure of inventions and are included to demonstrate further certain aspects of the inventions. The inventions may be better understood by reference to one or more of these figures in combination with the detailed description of certain embodiments presented herein.

Figure 1:
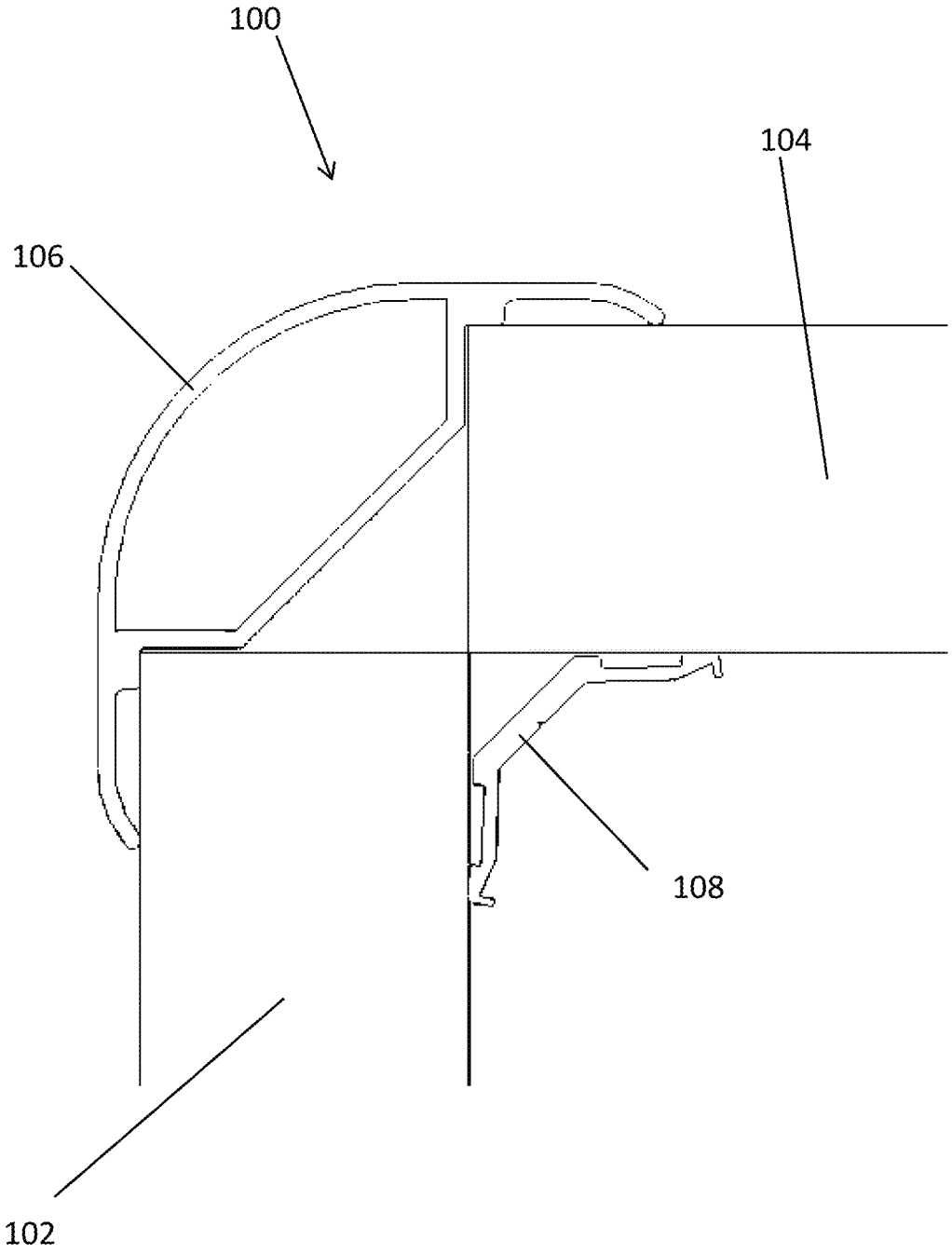
FIG. 1 (Prior Art)
FIG. 1 illustrates a prior art sandwich panel corner system.

While the inventions disclosed herein are susceptible to various modifications and alternative forms, only a few specific embodiments have been shown by way of example in the drawings and are described in more detail below. The figures and detailed descriptions of these embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts illustrated and taught by the specific embodiments.

DETAILED DESCRIPTION

The Figures described above, and the written description of specific structures and functions below, are not presented to limit the scope of the inventions disclosed or the scope of the appended claims. Rather, the Figures and written description are provided to teach a person skilled in this art to make and use the inventions for which patent protection is sought.

A person of skill in this art that has benefit of this disclosure will understand that the inventions are disclosed and taught herein by reference to specific embodiments, and that these specific embodiments are susceptible to numerous and various modifications and alternative forms without departing from the inventions we possess. For example, and not limitation, a person of skill in this art that has benefit of this disclosure will understand that Figures and/or embodiments that use one or more common structures or elements, such as a structure or an element identified by a common reference number, are linked together for all purposes of supporting and enabling our inventions, and that such individual Figures or embodiments are not disparate disclosures. A person of skill in this art having benefit of this disclosure immediately will recognize and understand the various other embodiments of our inventions having one or more of the structures or elements illustrated and/or described in the various linked embodiments. In other words, not all possible embodiments of our inventions are described or illustrated in this application, and one or more of the claims to our inventions may not be directed to a specific, disclosed example. Nonetheless, a person of skill in this art having benefit of this disclosure will understand that the claims are fully supported by the entirety of this disclosure.

Those persons skilled in this art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure.

Further, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the scope of what is claimed.

Reference throughout this disclosure to "one embodiment," "an embodiment," or similar language means that a particular feature, structure, or characteristic described in connection with the embodiment is included in at least one of the many possible embodiments of the present inventions. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of one embodiment may be combined in any suitable manner in one or more other embodiments. In the following description, numerous specific details are provided, such as examples of programming, software modules, user selections, network transactions, database queries, database structures, hardware modules, hardware circuits, hardware chips, etc., to provide a thorough understanding of embodiments of the disclosure. Those of skill in the art having the benefit of this disclosure will understand that the inventions may be practiced without one or more of the specific details, or with other methods, components, materials, and so forth. In other instances, well-known structures, materials, or operations are not shown or described in detail to avoid obscuring aspects of the disclosure.

The description of elements in each Figure may refer to elements of proceeding Figures. Like numbers refer to like elements in all figures, including alternate embodiments of like elements. In some possible embodiments, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

FIG. 1 illustrates conventional sandwich panels 102 and 104 joined to form a corner using conventional joinery 100 consisting of an exterior corner piece 106 and an interior corner piece 108.

Figure 2:
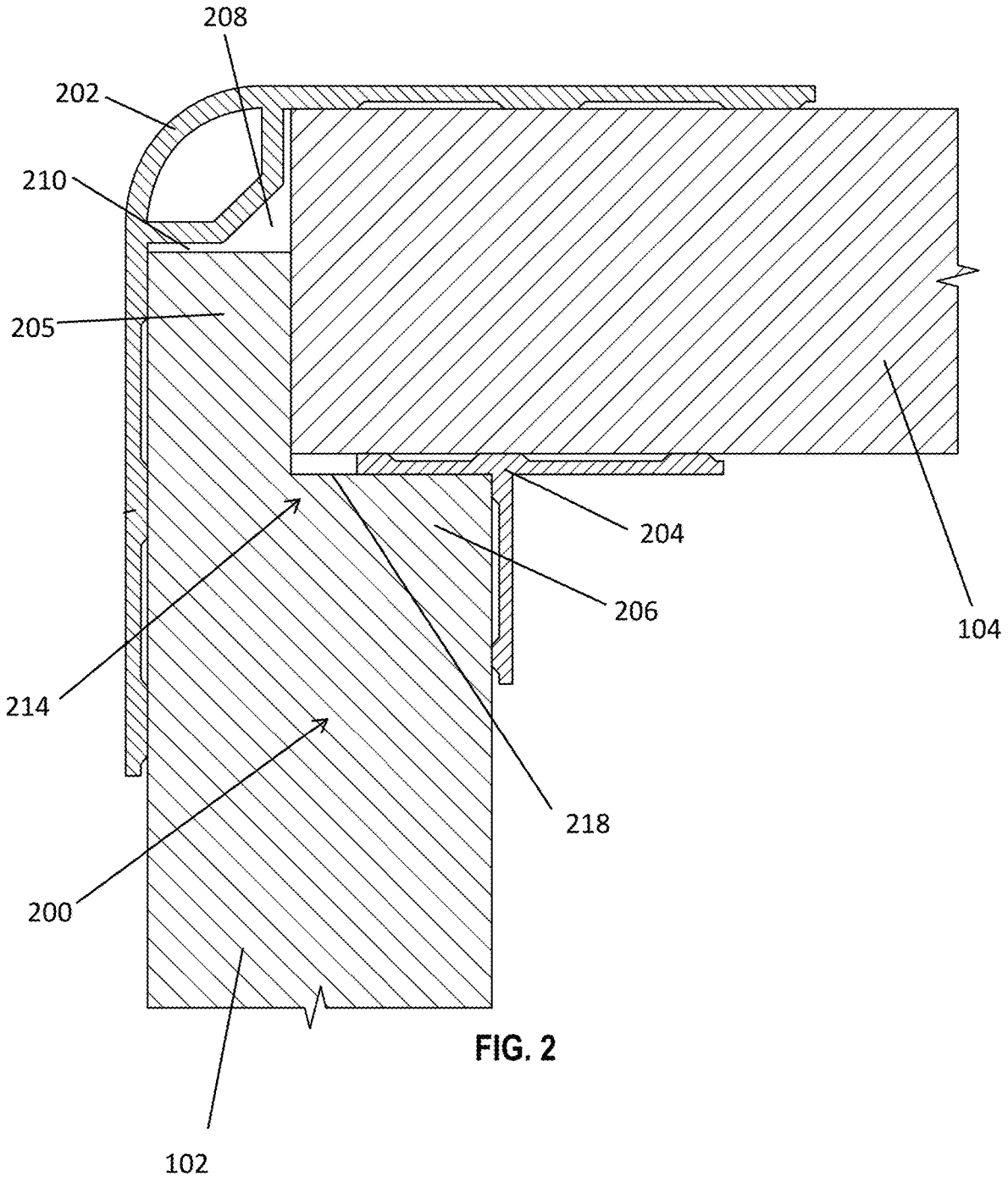
FIG. 2 illustrates an embodiment of a sandwich panel corner system according to the present inventions.

FIG. 2 illustrates an embodiment of a corner joint 200 according to the present inventions comprising conventional sandwich panels 102 and 104 using an exterior corner piece 202 and an interior corner flange 204. It is seen in FIG. 2 that panel 102 has a rabbet joint 214 cut or formed into an end of the panel 102. It will be appreciated that creating the rabbet joint 214 exposes two surfaces of the sandwich panel core 216 and 218. Note that core surface 216 contacts the core of sandwich panel 104.

Figure 3A:
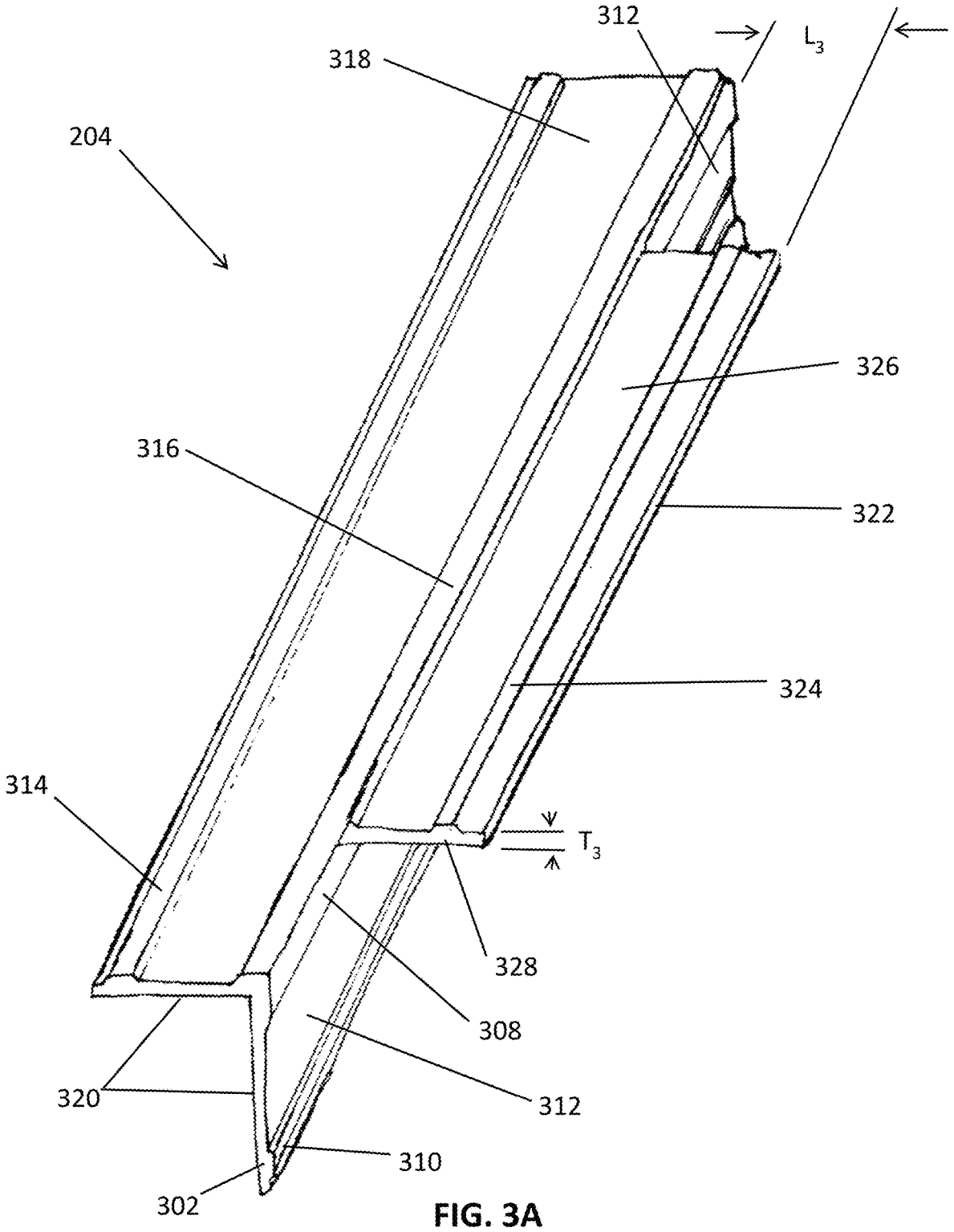
FIGS. 3A-3C illustrate embodiments of interior corner sandwich panel joining members according to the present inventions.
Figure 3B:
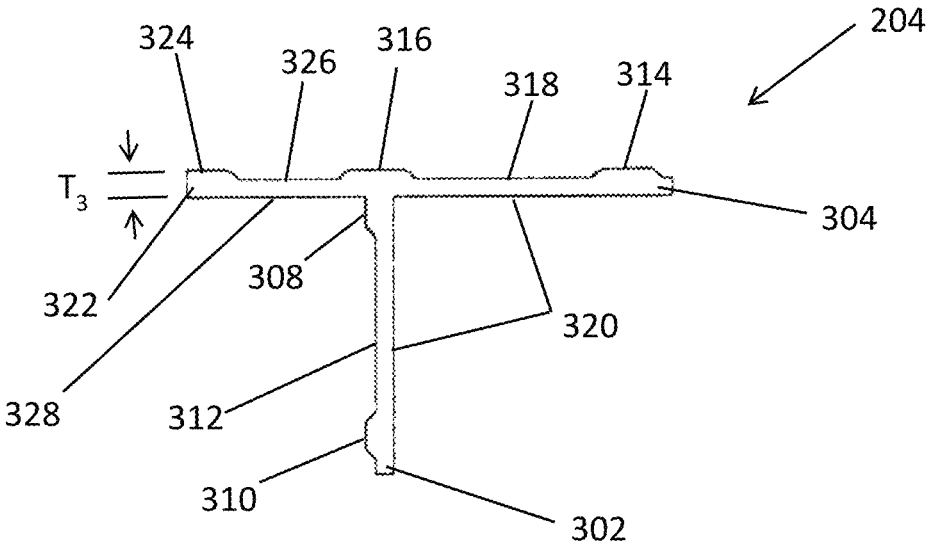
Figure 3C:
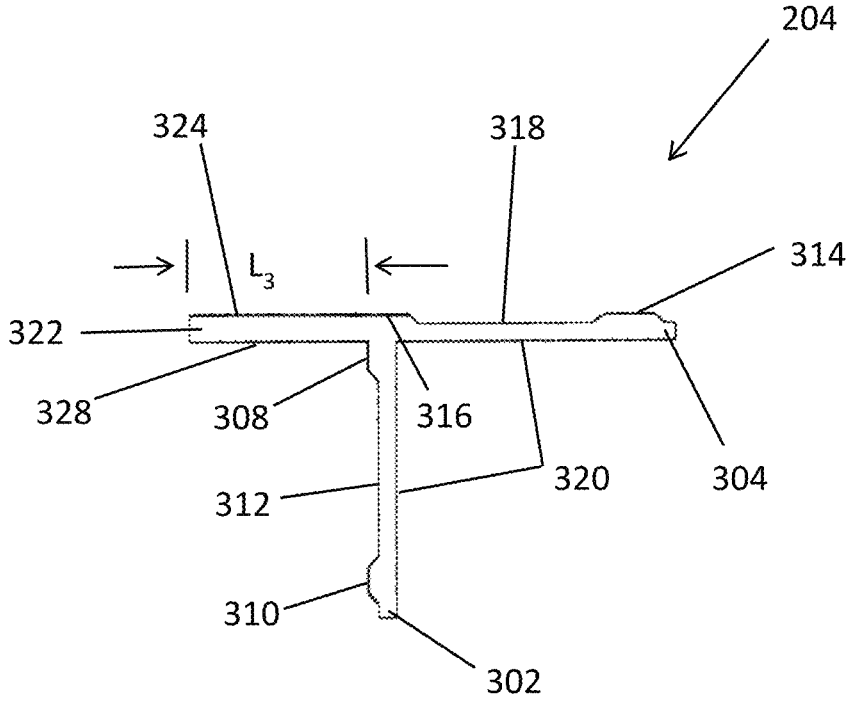

FIGS. 3A-3C illustrate multiple embodiments of an interior corner flange 204, comprising a first leg 302 and a second leg 304. One surface of leg 302 has one or more skin contacting surfaces 308 and 310 and one or more adhesive channels 312. A surface of leg 304 likewise has one or more skin contacting surfaces 314 and 316 and one or more adhesive channels 318. The outside surfaces of legs 302 and 304 define an interior corner surface 320, which may be aesthetically formed to comport with the visual aesthetics, if any, of the interior space.

The corner flange 204 further comprises a third leg 322 oriented normal to the first leg 302 and collinear with the second leg 304. As shown in FIG. 2, in use the third leg 322 extends into at least a portion of the rabbet joint 214.

As shown in FIGS. 3A-3C, the third leg 322 may have a transverse length (that is, normal to an axial length), $L_3$, that is less than the length of either of the first or second legs 302, 304. Alternately, the length, $L_3$, may be equal to or greater than the first and/or second legs 302, 304. Preferably, the length is equal to or less than either the first or second legs. In preferred embodiments, the length of the first and second legs are the same, and the length, $L_3$, of the third leg is less than that length.

The third leg 322 further comprises on a first side at least one skin contacting surface 324 and preferably, but optionally, at least one adhesive channel 326. FIG. 3C is illustrated to have a skin contacting surface 324 but no glue channel 326. A second side 328 of the third leg 322 opposite the first side may comprise a flat or planar or may comprise one or more adhesive channels like 326.

It is preferred, but not required, that the corner joint 200 be extruded or otherwise formed from aluminum or an aluminum alloy. It will be understood the corner joint 200 may be made or formed from any suitable material or materials, including fiber-reinforced plastic, composites, wood, and/or metal.

Returning to FIG. 2, it will be understood that because the third leg 322 of the corner flange 204 extends into the rabbet joint 214 it provides additional structural strength. More specifically, it is preferred that tongue 205 of the rabbet 214 is longer (or deeper) than the groove 206 of the rabbet 214 by at least the thickness, $T_3$, of the third leg 322, forming a rectangular rabbet.

Alternately, a square rabbet joint 214 may be used, in which the lengths of the tongue and groove are the same. Use of corner piece 106 with a square rabbet joint will cause the exterior corner pocket 208 to have exposures of unequal lengths, which in turn will increase the size of the glue channel 210. Because of the increased size of the glue channel 210 may compromise or reduce the structural integrity of the corner joint system, it is preferred, but not required, to use the rectangular rabbet joint 214 with the interior corner flange 204.

Figure 4A:
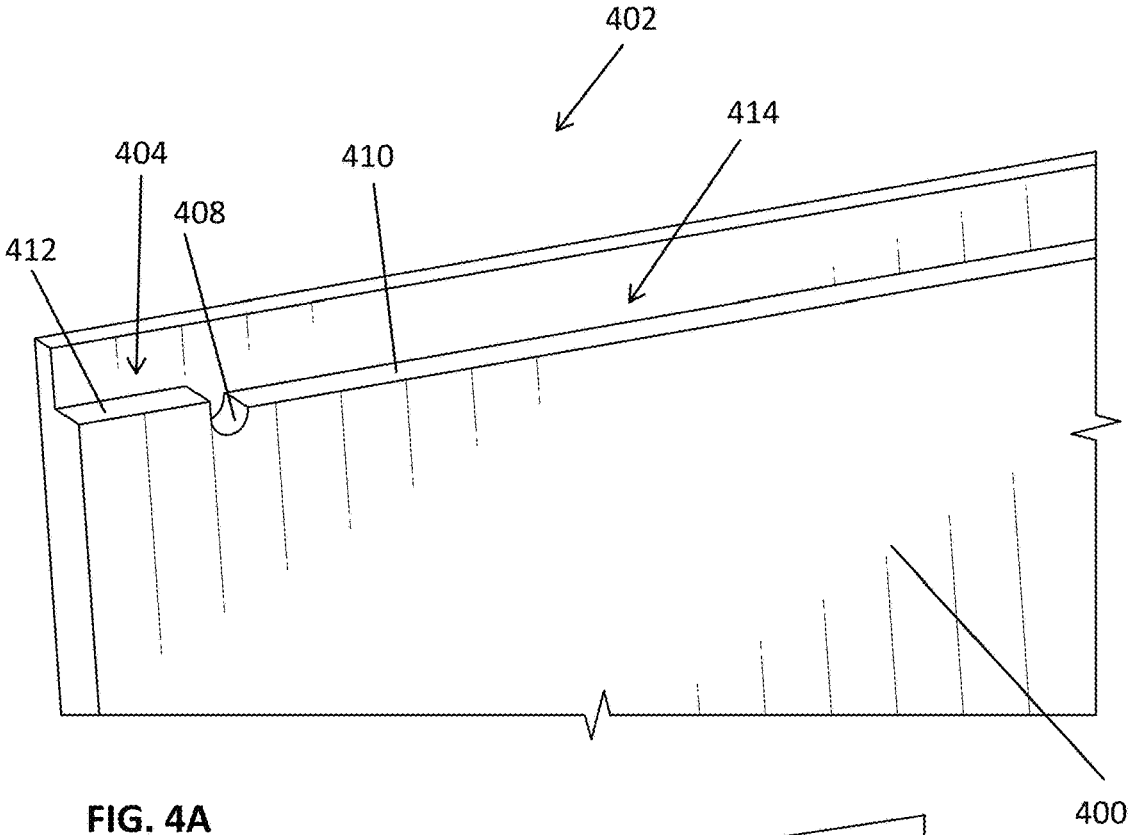
FIGS. 4A-4B illustrate conventional sandwich panels modified for the interior corner sandwich panel joining members of FIGS. 3A-3C.

FIG. 4A illustrates a conventional sandwich panel 400 with a first embodiment of a modified rabbet joint 402 for use with some of the interior corner flanges of the present inventions. The panel 400 comprises a first rabbet joint 404 and second rabbet joint 406 (not shown) at the other panel end. These joints 404, 406 are described as square in that the lengths of the tongue and groove portions may be the same. Also shown in FIG. 4 is an entry point 408 for a tool, such as a router bit for creating a third rabbet 414 with a modified groove surface 410. For example, the elevation of modified groove surface 410 is machined, such as by a router bit, lower than the groove surface 412 of rabbet 404, 406 by a distance, such as the thickness, $T_3$, of the third leg 322. It will be appreciated that using this modified rabbet joint 402 allows the use of an exterior corner piece 202.

Figure 4B:
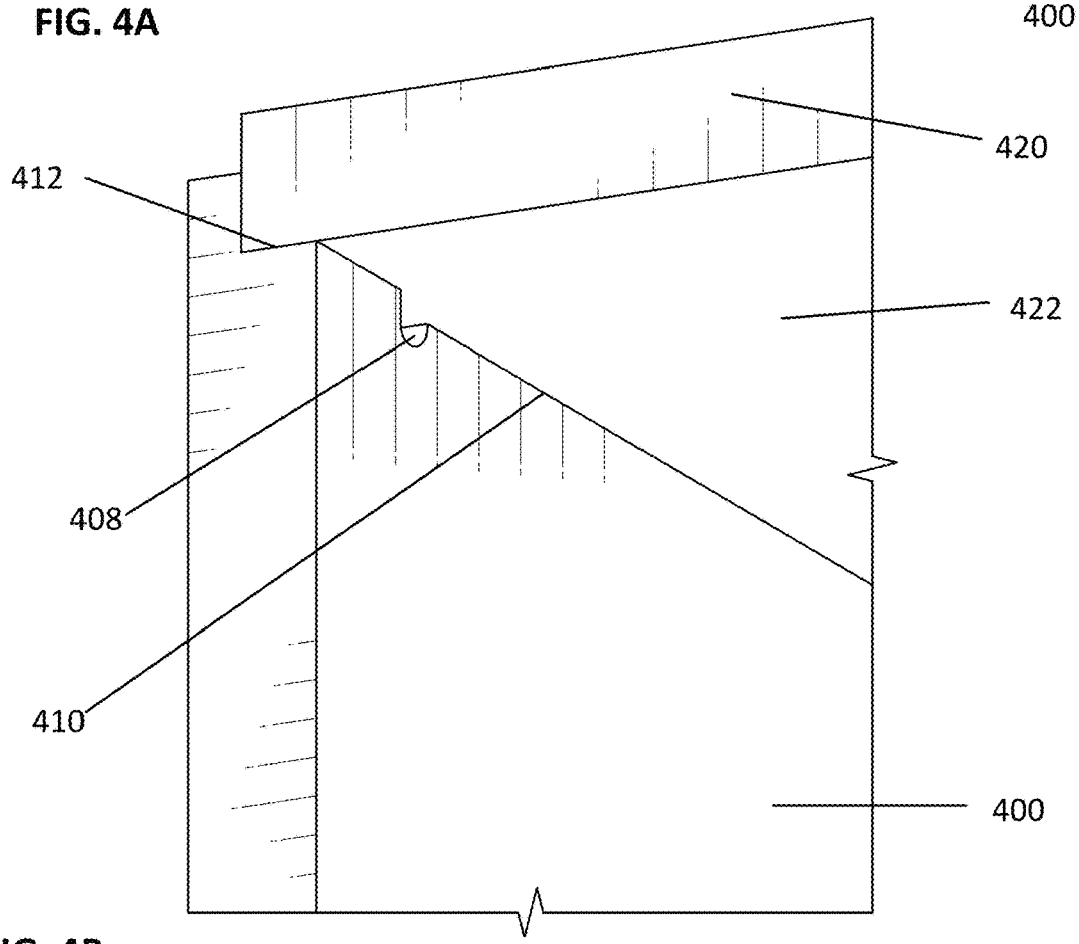

FIG. 4B illustrates the modified panel 400 coupled with a conventional panel 420. In this figure it is seen that the skin 422 of the panel 420 contacts the groove 412 of rabbet 404, but it does not contact the groove surface 410 because that surface is lower than surface 412 by an amount, such as $T_3$ as discussed above.

Figure 5A:
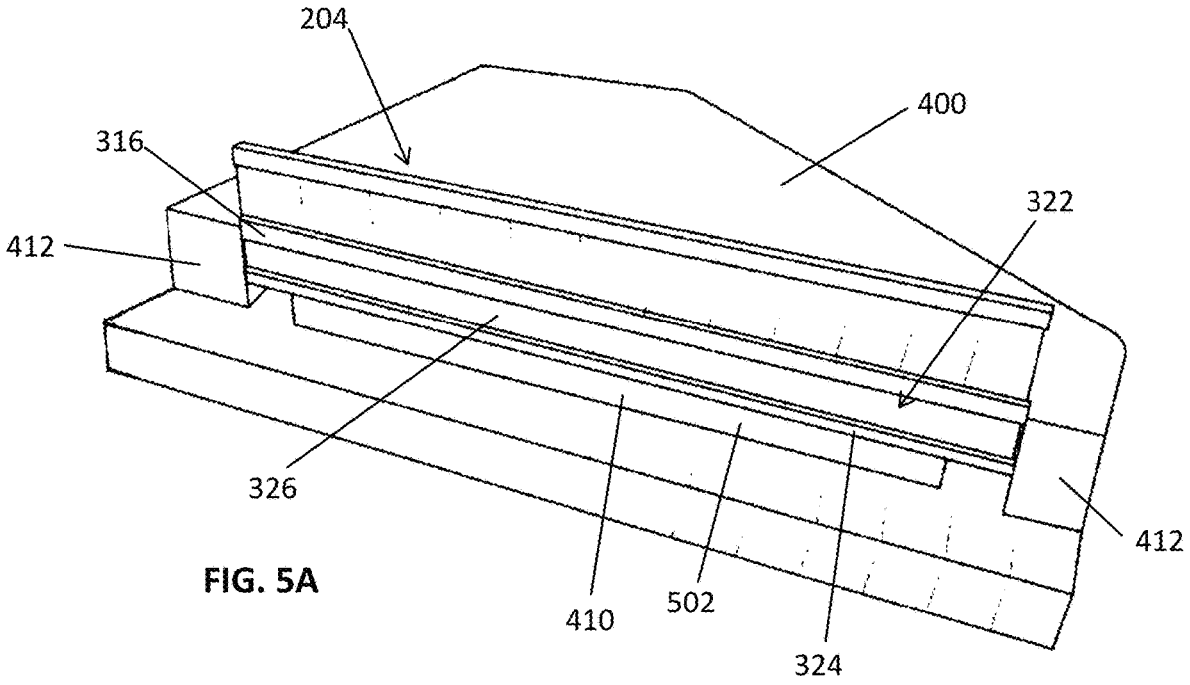
FIGS. 5A-5B illustrate the modified panels of FIG. 4A. with an interior corner sandwich panel joining member in position.
Figure 5B:
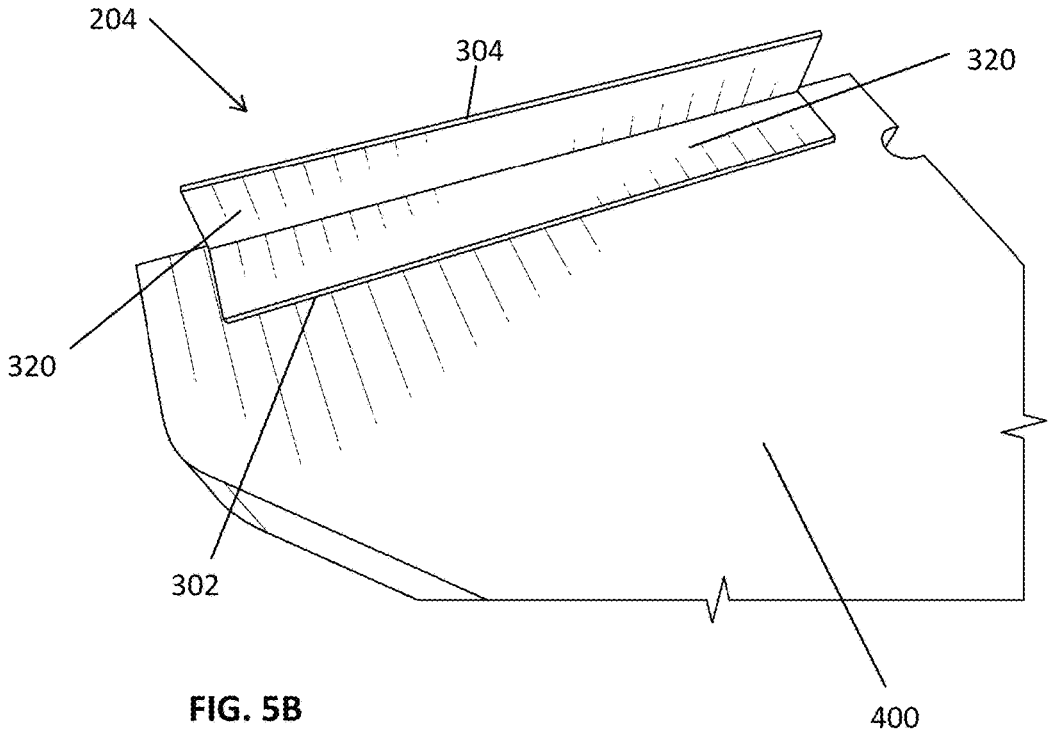

FIGS. 5A-5B illustrate modified panel 400 with interior corner flange 204 in position such that the second side 328 of the third leg 322 contacts the groove surface 410. In this embodiment, because groove surface 410 is lower than groove surface 412, contacting surfaces 316 and 324 on the interior corner flange 204 are at the same elevation as groove surface 412 thereby creating a glue channel 326 with the desired spacing.

FIG. 5A illustrates a standoff region 502 on surface 410 into which the third leg 322 does not extend. This is illustrated to disclose that exterior corner flange 204 may optionally comprise a first dimensional configuration that can be used with multiple panel thicknesses, rather than having individual exterior corner flanges for each discrete panel thickness.

Figure 6:
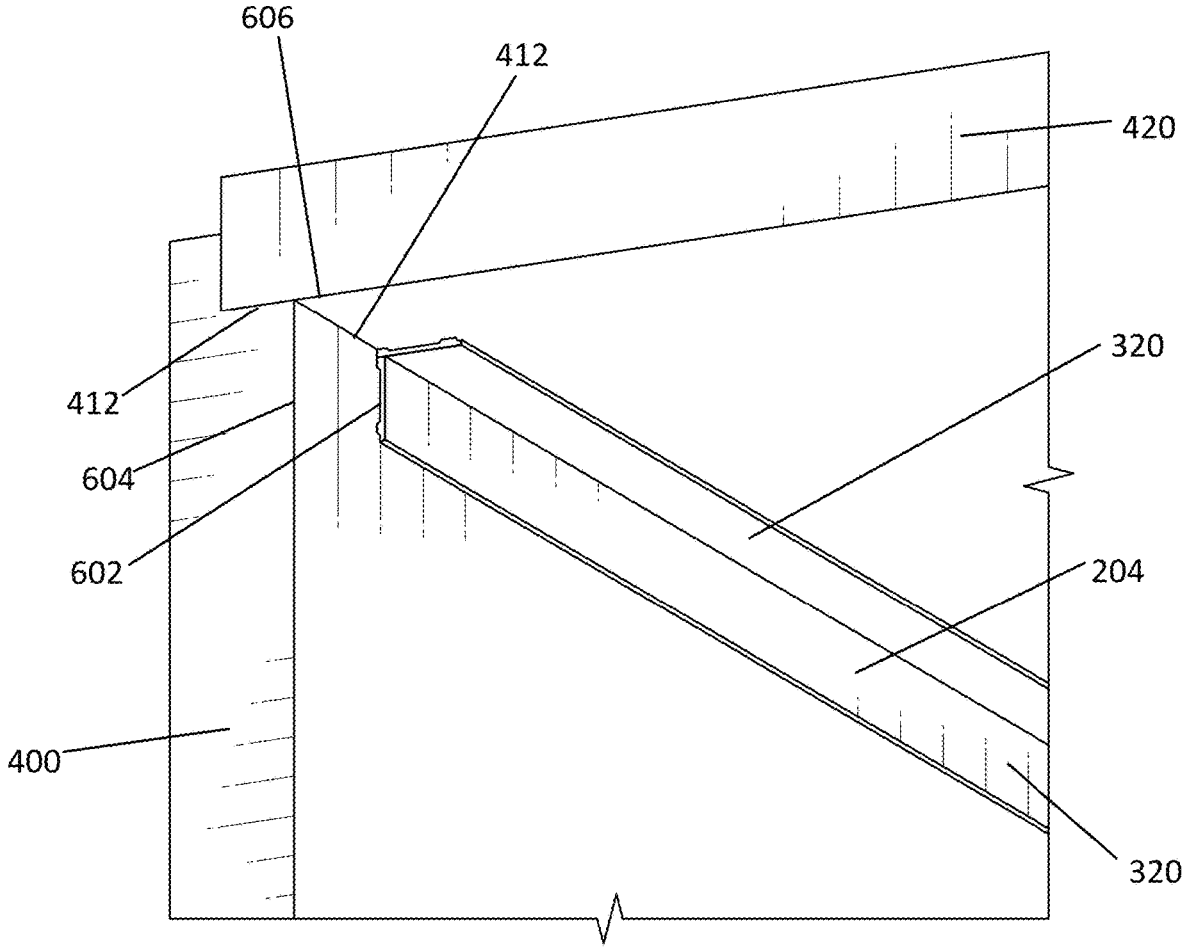
FIG. 6 illustrates the panels of FIG. 4B with an interior corner sandwich panel joining member in position.

FIG. 6 illustrates the panel system of FIG. 4B with an interior corner flange 204 of the present inventions in place. The contact between the skin of panel 420 and groove surface 412 is shown. As illustrated in FIG. 6 the end 602 of the corner flange 204 is shown not extending to the edges 604, 606 of the panels. It will be appreciated that the interior surfaces 320 of the corner flange 200 can be extended to the edges 604 and 606, as illustrated, for example, in FIG. 3A.

Figure 7:
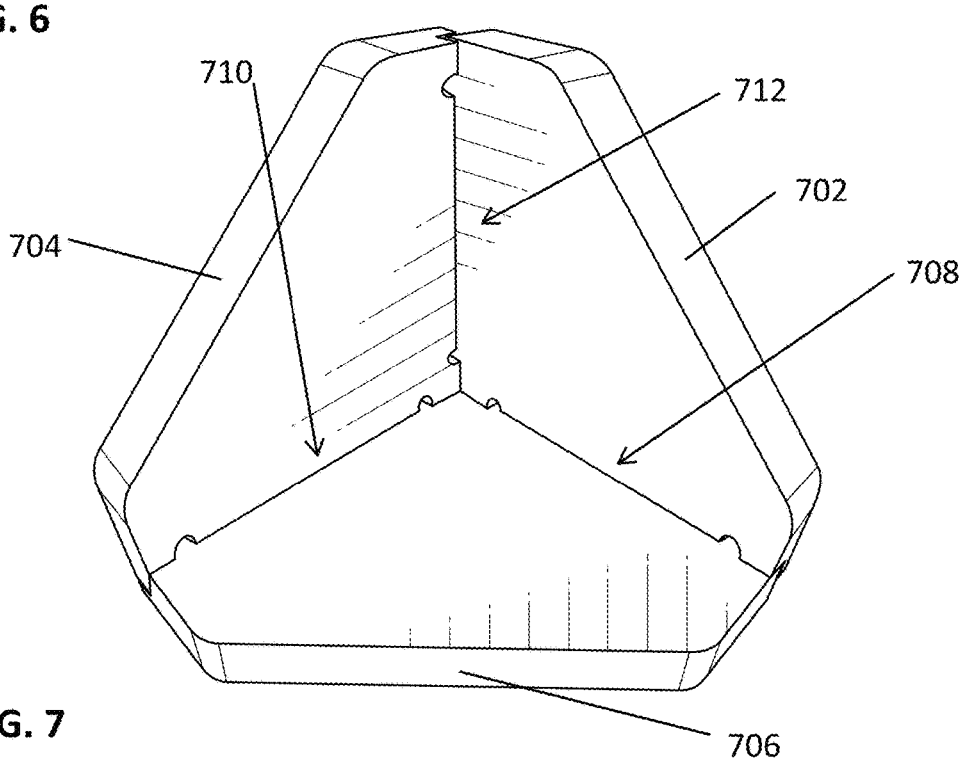
FIG. 7 illustrates three sandwich panels in a corner configuration for use with interior corner sandwich panel joining members according to the present inventions.

FIG. 7 illustrates a three panel corner such as the intersection of walls 702, 704 and floor 706. In this embodiment, wall 702 is shown to have a modified rabbet joint 708 and wall panel 704 has two modified rabbet joints 710 and 712.

Figure 8A:
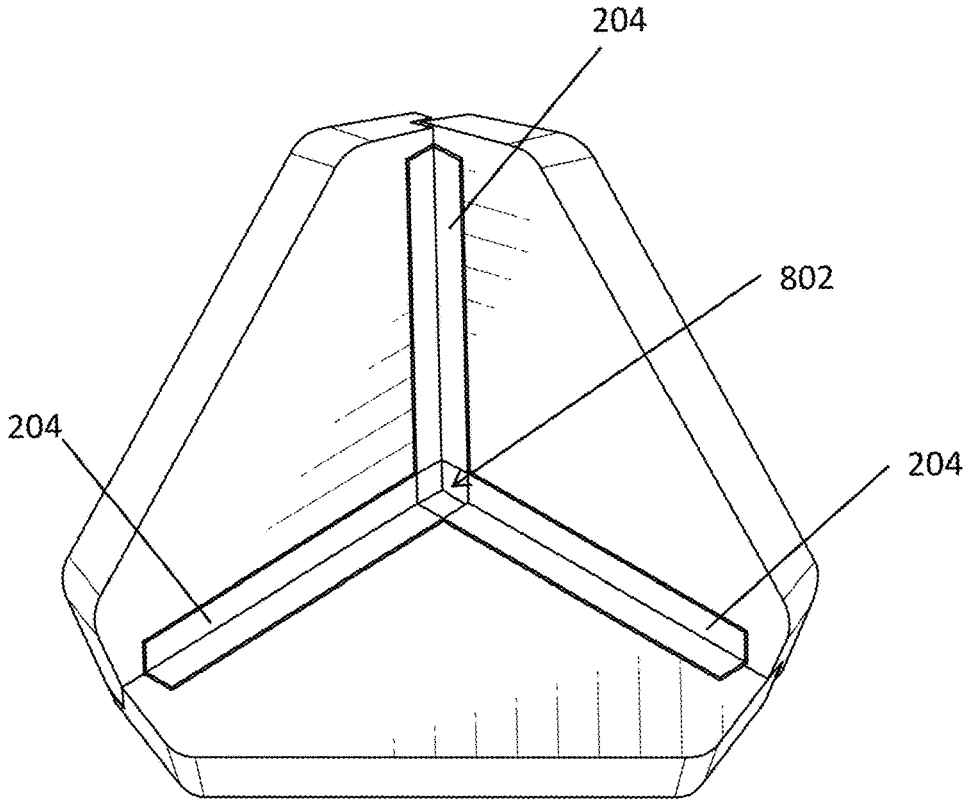
FIGS. 8A-8B illustrate the panels of FIG. 7 joined with interior corner sandwich panel joining members according to the present inventions.
Figure 8B:
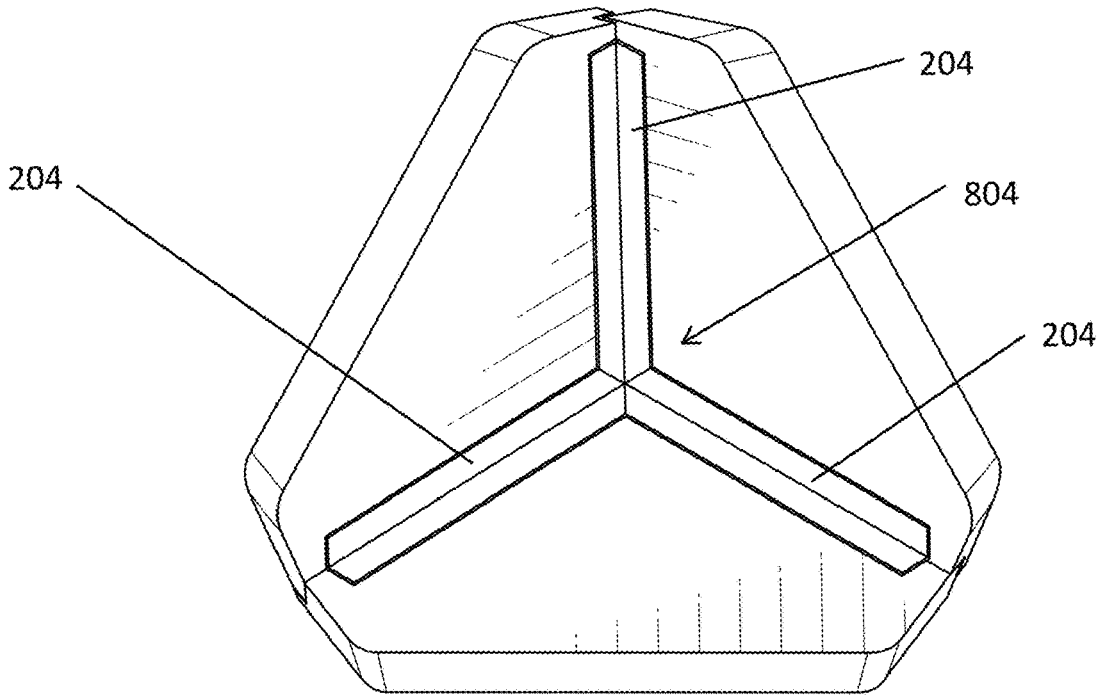

As illustrated in FIGS. 8A-8B, if the interior corner flanges 204 have square or butt ends, they can abut together leaving an exposed cube-like space 802 of panel skin. Alternately, the ends of the flanges 204 can be extended (see FIG. 3A) and cut on an angle so the ends all meet at the panel corner 804.

Figure 9:
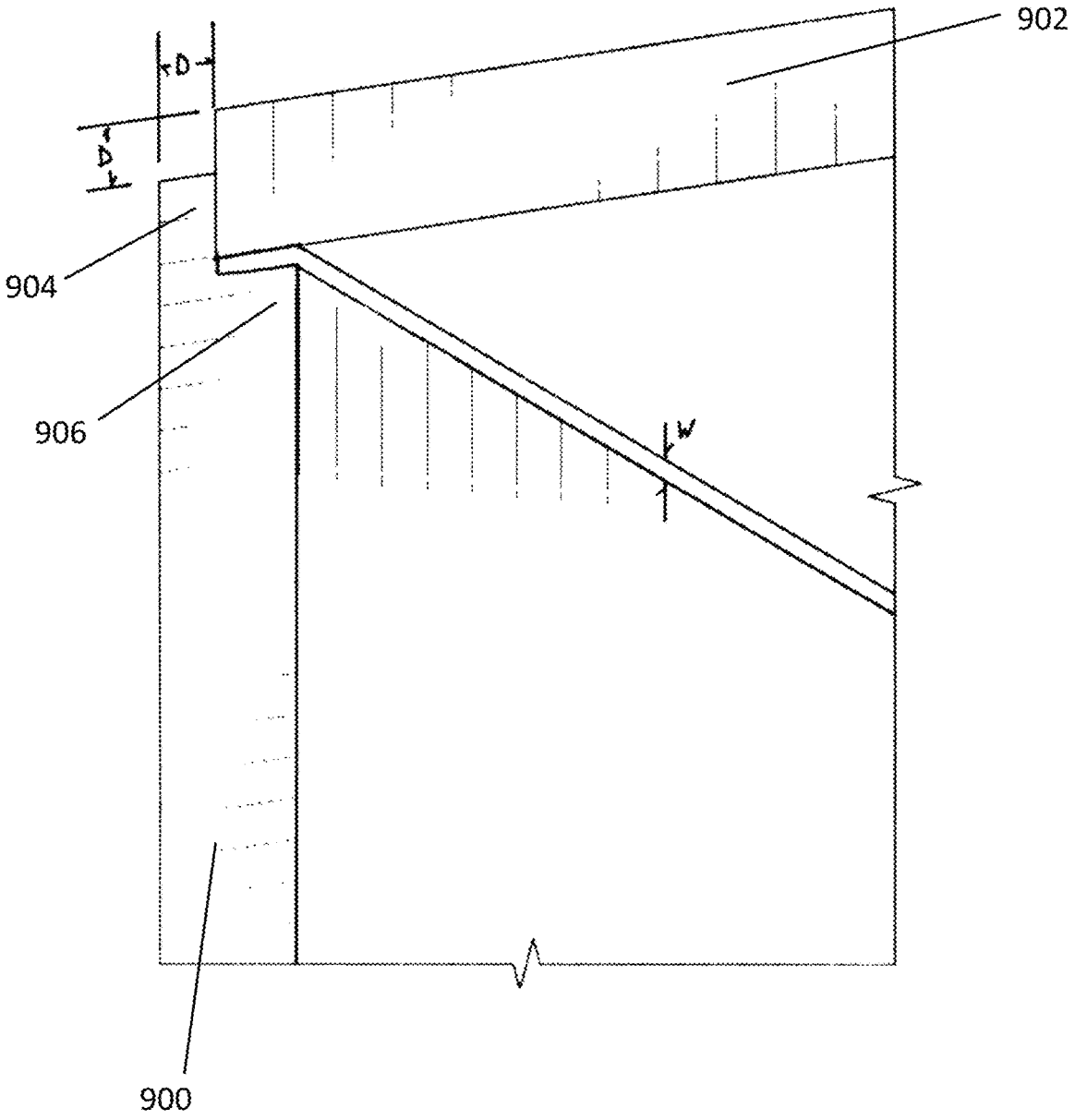
FIG. 9 illustrates conventional sandwich panels modified for the interior corner sandwich panel joining members according to the present inventions.

FIG. 9 illustrates another embodiment utilizing aspects of the present inventions. With reference to FIGS. 4A-4B, FIG. 9 disclose a panel 900 with a single rabbet joint from end-to-end of the panel. In other words, and unlike the panel 400 in FIG. 4A, the rabbet joint does not have surfaces 412 at each end that contact the skin of panel 902. Because panel 900 has a single rabbet joint, it is preferred, but not required that the interior corner flange used with these panels extend in length from panel end to panel end. The third leg of the interior flange, such as leg 322, can, and preferably does extend the entire length of the interior flange, unlike as illustrated in FIG. 3A. As discussed above, the ends of the interior flange can be shaped, such as arrowed or butted, as desired or required. It will be understood forming the single rabbet, such as by machining, is easier and less costly than forming the multi-tiered rabbet of FIGS. 4A-4B.

Figure 10:
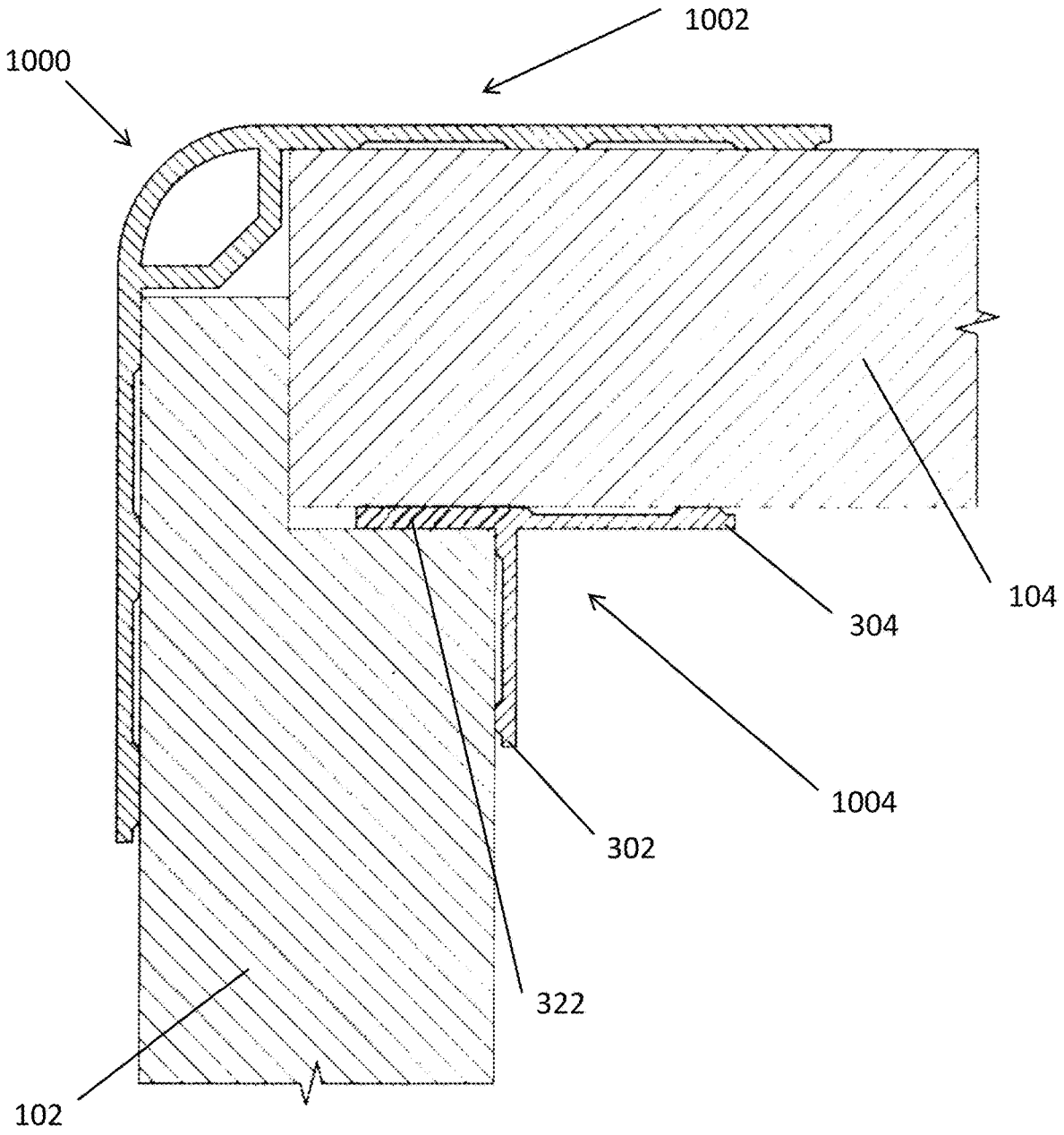
FIG. 10 illustrates another embodiment of a sandwich panel corner system according to the present inventions.

FIG. 10 illustrates an embodiment of a corner joint 1000 comprising an exterior corner piece 1002 and interior corner piece 1004, as previously discussed. In this figure, the interior corner piece 1004 is shown to the interior flange of FIG. 3C in which the third leg 322 does not utilize a glue channel. The interior corner piece may extend the length of the panel from end-to-end, such as illustrated and described in FIG. 8B, or extend the length of the rabbet joint for the third leg, such as illustrated in FIGS. 5A-5B. As illustrated in FIG. 3A, and depending on the nature of the rabbet joint, the length of the third leg 322 can be truncated at one or both ends or can extend to ends of the first and second legs 302, 304. For embodiments that use an interior corner flange without a glue channel (see FIG. 3C), it is preferred, but not required, that the third leg 322 extend to the ends of the first and second legs.

Figure 11:
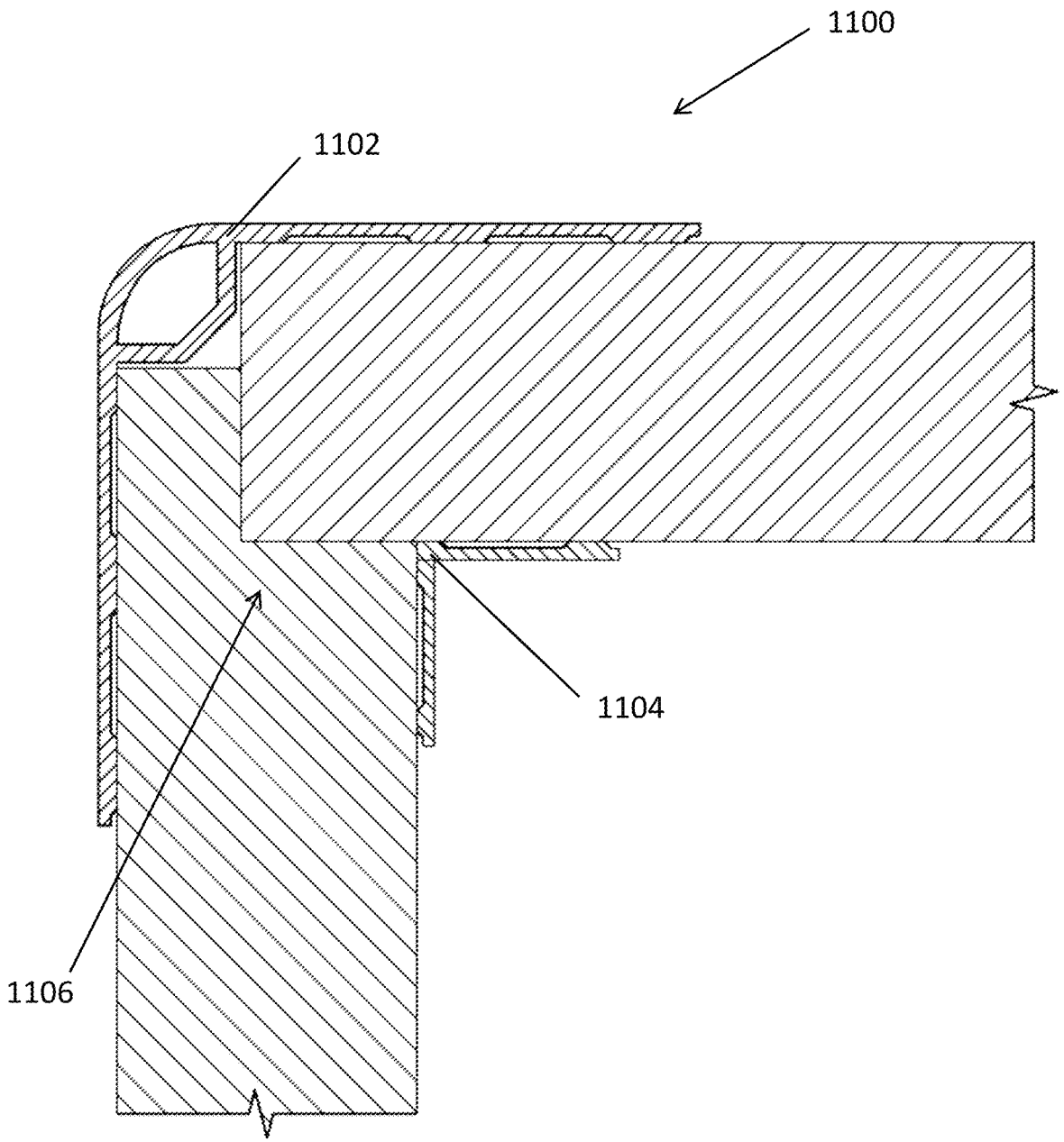
FIG. 11 illustrates yet another embodiment of a sandwich panel corner system according to the present inventions.

The structure illustrated in FIG. 1 of U.S. Provisional Application No. 63/697,931 filed on Sep. 23, 2024, was labeled "Prior Art," however, that label made in error and the structure illustrated in FIG. 1 of that provisional application was not prior art. Because it was not prior art, FIG. 1 of U.S. Provisional Application No. 63/697,931 is reprinted here as FIG. 11 and illustrates yet another embodiment of our inventions using an exterior corner piece 1102, such as described above and an L-shaped interior corner piece 1104 that does not utilize a third leg that extends into the rabbet joint 1106. The description of the corner joints provided above for FIGS. 2-10 apply equally to embodiments utilizing an L-shaped, two leg interior flange except for the absence of the third leg.

Other and further embodiments utilizing one or more aspects of the inventions described above can be devised without departing from the spirit of Applicant's invention. Further, the various methods and embodiments of the methods of manufacture and assembly of the system, as well as location specifications, can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to protect fully all such modifications and improvements that come within the scope or range of equivalent of the following claims.

The invention claimed is:

1. A wall panel system, comprising:

a first wall panel having a first core with skin adhered to outer surfaces of the first core and having a first end;

a second wall panel having a second core with skin adhered to outer surfaces of the second core and having a rabbet joint at an end for receiving at least a portion of the first end of the first wall panel;

an interior corner flange having three portions forming a T shape, a first and a second of the three portions each having an interior corner exterior surface and panel skin surface, a third of the three portions having a transverse length equal to or less than either or both of the first and second portions;

such that the skin surface of the first portion of the interior corner flange contacts the first panel skin and the skin surface of second portion of the interior corner flange contacts the second panel skin; and wherein the third portion of the interior corner flange extends into the rabbet joint and is sandwiched between a portion of the first panel and a groove of the rabbet joint.

2. The system of claim 1, wherein the rabbet joint is not square.

3. The system of claim 2, wherein the first and second portions of interior corner flange each comprise one or more adhesive receptacles for adhering the portions to the panel skin.

4. The system of claim 3, further comprising adhesive in one or more of the adhesive receptacles securing the interior corner flange to the first and second panels.

5. The system of claim 4, further comprising an exterior corner piece having a first portion that contacts the first wall panel skin, and a second portion that contacts the second wall panel skin.

6. The system of claim 5, wherein the first and second portions of the exterior corner piece each comprise one or more adhesive receptacles for adhering the portions to the panel skin, and comprising adhesive in one or more of the exterior corner piece adhesive receptacles securing the exterior corner piece to the first and second panels.

7. A sandwich panel corner joint, comprising:

a first and second sandwich panels each comprising a core having two wall surfaces, two ends, and a rigid skin structurally coupled to each of the two wall surfaces;

a rabbet joint formed in the first panel along an end comprising two end portions and a flange portion, the two end portions each defining a groove surface formed a first axial distance from the first panel edge and a first depth from a skin surface, and the flange portion defining a flange groove surface formed at a second, longer axial distance from the first panel edge;

an interior corner flange having an axial length less than or equal to a length of the first panel end surface, and having three portions forming a T-shaped cross section;

the first and second portions of the interior flange each having an exposed corner surface and a skin surface opposite the exposed corner surface, the skin surfaces each comprising at least one channel along the axial length;

the third portion of the interior corner flange having a thickness T, a rabbet groove surface, and a skin surface, the third portion having a transverse depth that is equal to or less than a depth of the flange groove surface;

wherein when the first panel, second panel, and interior corner flange are assembled in operative manner, the third portion of the interior corner flange extends into the flange portion of the rabbet joint.

8. The joint of claim 7, wherein the flange portion of the rabbet joint is not square.

9. The joint of claim 7, wherein the skin surface of the interior corner flange third portion comprises one or more adhesive receptacles, and further comprising adhesive securing the interior corner flange to the first and second panels.

10. The joint of claim 7, further comprising an exterior corner piece having a first portion that contacts the first wall panel skin, and a second portion that contacts the second wall panel skin.

11. The joint of claim 7, wherein a transverse length of the third portion is less than a transverse length of the first portion and a transverse length of the second portion.

12. The joint of claim 7, wherein the interior corner flange has an axial length equal to a length of the first panel end surface.

* * * * *